US012798736B2

(12) United States Patent
Golden et al.

(10) Patent No.: US 12,798,736 B2
(45) Date of Patent: Nov. 17, 2026

(54) HYDRAULIC BOAT LIFT WITH BUNK MOUNTED CYLINDERS

(71) Applicants: William Golden, North Fort Myers, FL (US); Bret Niccum, Marco Island, FL (US); Brendan Kimball Chase, Cape Coral, FL (US)

(72) Inventors: William Golden, North Fort Myers, FL (US); Bret Niccum, Marco Island, FL (US); Brendan Kimball Chase, Cape Coral, FL (US)

( * ) Notice: Subject to any disclaimer, the term of this patent is extended or adjusted under 35 U.S.C. 154(b) by 0 days.

(21) Appl. No.: 18/644,502

(22) Filed: Apr. 24, 2024

(65) Prior Publication Data

US 2024/0359781 A1 Oct. 31, 2024

Related U.S. Application Data

(60) Provisional application No. 63/527,141, filed on Jul. 17, 2023, provisional application No. 63/462,073, filed on Apr. 26, 2023.

(51) Int. Cl.
*B63C 3/06* (2006.01)

(52) U.S. Cl.
CPC ..... *B63C 3/06* (2013.01)

(58) Field of Classification Search
CPC ..... B63C 3/06; B63C 3/12
See application file for complete search history.

(56) References Cited

U.S. PATENT DOCUMENTS 5,184,914 A * 2/1993 Basta ..... B63C 3/06 D34/28
5,890,835 A * 4/1999 Basta ..... B63C 3/06 114/44
6,837,651 B1 * 1/2005 Basta ..... B63C 3/12 405/3
7,246,970 B2 * 7/2007 Hey ..... B63C 3/12 114/44
10,059,412 B1 * 8/2018 Basta ..... B66F 7/0641 405/3
2004/0089212 A1 * 5/2004 Vinnik ..... B63C 1/02 114/44
2006/0147268 A1 * 7/2006 Hey ..... B63C 3/06 405/3
2014/0017009 A1 * 1/2014 Hey ..... B63C 3/06 405/3
2015/0210360 A1 * 7/2015 Hodapp ..... B63C 3/06 114/343
2015/0321730 A1 * 11/2015 Hey ..... B63B 17/02 114/361
2022/0048603 A1 * 2/2022 Buksowicz ..... B63C 3/06 405/3

FOREIGN PATENT DOCUMENTS

CA 2787731 C * 1/2018 ..... F16B 2/06
CA 3128217 A1 * 2/2022 ..... B63C 3/06
WO WO-2010085694 A2 * 7/2010 ..... B66F 7/08

* cited by examiner

*Primary Examiner* — Jong-Suk (James) Lee
(74) *Attorney, Agent, or Firm* — William E. Noonan

(57) ABSTRACT

A hydraulic boat lift includes an underlying framework and a pair of elongate bunks. Each bunk is pivotally connected to the framework by a respective pair of leading and trailing vertical support beams. A respective hydraulic cylinder actuator operatively interengages each trailing vertical support beam and its connected bunk. The actuators operate to selectively alternate the lift between raised and lowered conditions.

12 Claims, 7 Drawing Sheets

HYDRAULIC BOAT LIFT WITH BUNK MOUNTED CYLINDERS

RELATED APPLICATION

This application claims the benefit of U.S. Provisional Application Ser. No. 63/462,073 filed Apr. 26, 2023 and U.S. Provisional Application Ser. No. 63/527,141 filed Jul. 17, 2023.

FIELD OF THE INVENTION

This invention relates to a hydraulic boat lift wherein each hydraulic cylinder is operatively mounted between a respective bunk and pivotally interconnected vertical support beam.

BACKGROUND OF THE INVENTION

Hydraulic boat lifts conventionally employ hydraulic cylinders for selective raising and lowering the lift. Each such cylinder is operatively interconnected between a horizontally oriented underlying frame and a respective vertical support post or beam that is itself pivotally attached to the underlying frame. Accordingly, the hydraulic cylinders remain largely, if not entirely submerged and difficult to access, which complicates needed maintenance, repair and replacement of the cylinders. A further problem occurs if the hydraulic cylinders fail or malfunction (e.g., from a loss of hydraulic pressure) with the lift in a raised condition. Cylinder failure can cause the vertical support beams to sag and pivotally lower the lift. As a result, the bunks of the lift are apt to tilt downwardly into the water and the supported vessel may slide off the lift and be set adrift, damaged or lost.

SUMMARY OF THE INVENTION

It is therefore an object of the present invention to provide a hydraulic boat lift that employs hydraulic cylinders that are operatively interengaged between the bunks and respective vertical support beams of the lift.

It is a further object of this invention to provide a hydraulic boat lift wherein the hydraulic cylinders for raising and lowering the lift are mounted in an elevated manner between the horizontal bunks and pivoting vertical support beams of the lift so that the cylinders are more accessible and maintenance, repair and replacement of the cylinders is facilitated.

It is a further object of this invention to provide a hydraulic boat lift that maintains the lift in an elevated and upright position in the event of the failure of one or more of the hydraulic cylinders and which prevents unintended lower of the lift and potential damage to or loss of the supported vessel.

It is a further object of this invention to provide a hydraulic boat lift that operates smoothly and effectively.

It is a further object of this invention to provide a hydraulic boat that compactly lowers a supported vessel to a reduced water depth without unduly straining and potentially damaging the hinge pins of the lift's vertical supports.

It is a further object of this invention to provide a hydraulic boat lift that protects the hydraulic cylinder actuators, and particularly the reciprocating piston rods of those cylinders against premature corrosion and deterioration from surrounding marine environments and adverse weather conditions.

This invention features a hydraulic boat lift for supporting a boat or other marine vessel. The hydraulic lift includes a supportive base that features a framework including a generally parallel pair of first and second side beams. A leading vertical support includes a first spaced apart pair of laterally adjacent leading vertical support beams pivotally or hingedly attached at their lower ends respectively to the first and second side beams proximate a leading (bow) end of the framework. A trailing vertical support includes a second spaced apart pair of laterally adjacent trailing vertical support beams likewise pivotally or hingedly attached at their lower ends to the respective side beams proximate an opposite, trailing (stern) end of the framework. The vertical support beams attached to the first side beam, in turn, carry and are pivotally interconnected to a first elongate bunk. Likewise, the vertical support beams attached to the second side beam carry and are pivotally connected to a second elongate bunk. Each vertical support beam of either the leading vertical support beams or the trailing vertical support beams is pivotally connected to one end of a respective hydraulic cylinder actuator. The opposite end of that hydraulic cylinder is pivotally interconnected to a corresponding one of the first and second bunks. The hydraulic cylinders are operated to selectively pivot the vertical support beams between an open, raised, and upright condition, wherein the elongate bunks elevate a vessel supported thereon, and a closed, folded, and lowered condition, wherein the elongate bunks are lowered to maneuver the vessel onto and off of the lift.

In a preferred embodiment, each cylinder actuator includes a piston rod pivotally attached to one of either a respective bunk or its corresponding vertical support beam. Each cylinder actuator also includes a cylinder barrel or housing pivotally attached to the other of the respective bunk or its corresponding vertical support beam. Each rod is operatively interengaged with a respective cylinder housing for moving in a reciprocating manner inwardly and outwardly relative to the housing. In some versions, the rods may be retracted into their respective cylinder housings to pivotally open the bunks and vertical support beams, and thereby elevate the lift. In such versions, the rods are extended from their respective cylinder housings to pull the bunks and vertical support beams pivotally closed, and thereby lower the lift. In other embodiments the rods may be extended from their respective cylinder housings to pivotally open the bunks and the vertical support beams, and thereby elevate the lift. Alternately, in such other embodiments, the rods are retracted within their respective cylinder housing to pull the bunks and vertical support beams pivotally closed, and thereby lower the lift.

The leading vertical support beams may be interconnected by a first lateral strut to define a leading H-frame that is pivotally attached to the supportive base. The trailing vertical support beams may be interconnected by a second lateral strut to define a trailing H-frame that is pivotally attached to the supportive base.

The vertical support beams are pivotally mounted to the underlying side beams such that when the hydraulic cylinder actuators are operated to extend the rods from their respective cylinder housings, each vertical support beam pivots overcenter relative to its attached side beam to form an angle greater than 90 degrees relative to the trailing end of the side beam. This restricts the vertical support beams from pivoting closed in the event that one or more of the hydraulic cylinder actuators fail from a loss of hydraulic pressure.

The cylinder actuators may be interconnected between the leading vertical support beams and respective bunks or between the trailing vertical support beams and respective bunks. When the cylinder actuators are attached to the leading vertical support beams and the lift is elevated, the cylinder rods remain largely retracted within their respective cylinder housings. As a result, the cylinder rods are, at most times, largely immersed within hydraulic fluid. This protects the rods against corrosion and premature deterioration, which may otherwise result from prolonged exposure to a harsh marine environment and adverse weather conditions.

BRIEF DESCRIPTION OF THE DRAWINGS

Other objects, features and advantages will occur from the following description of a preferred embodiment and the accompanying drawings, in which.

DETAILED DESCRIPTION OF INVENTION

Figure 1:
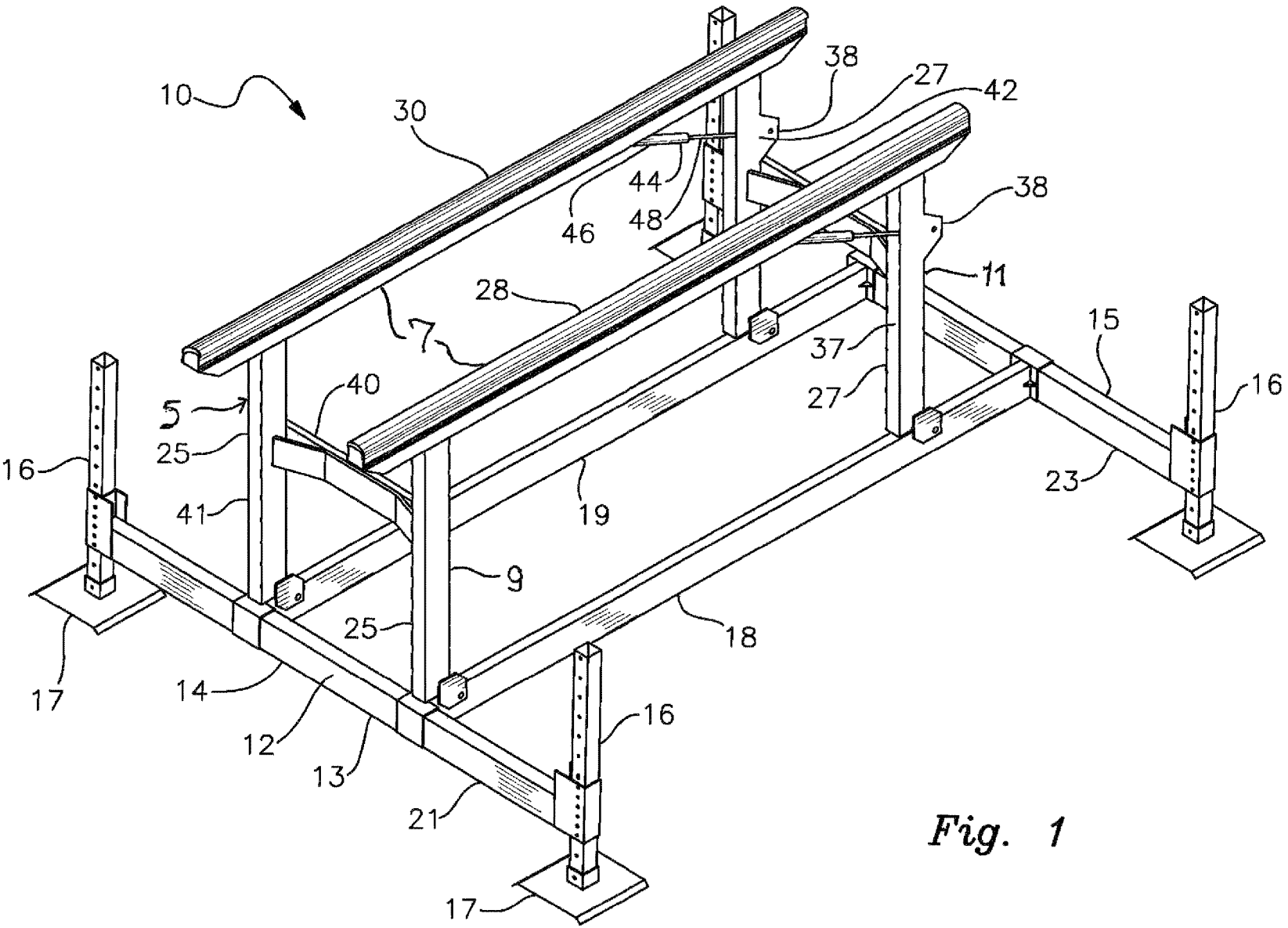
FIG. 1 is a perspective view of a preferred hydraulic boat lift in accordance with this invention showing the lift in a raised or elevated condition.
Figure 2:
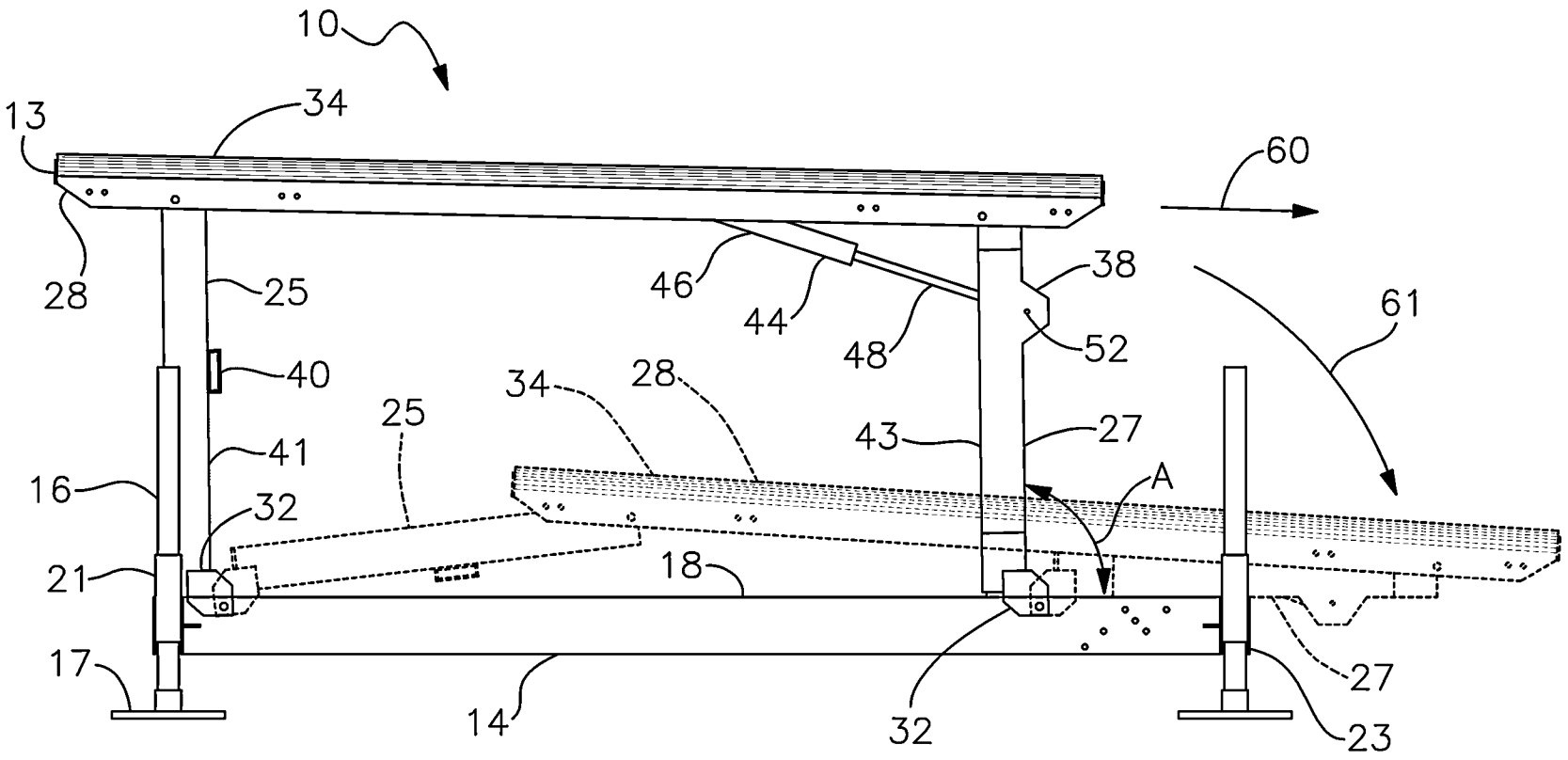
FIG. 2 is an elevational side view of the preferred hydraulic boat lift in the raised or elevated condition and alternately depicting, in phantom, the lift in a lowered condition.

There is shown in FIGS. 1 and 2 a hydraulic boat lift 10 for supporting a boat or other marine vessel (not shown) within a body of water. Lift 10 may be used for various large and small boats and marine vessels and may be employed in various bodies of water and marine environments. The type of vessel and the location wherein the lift may be employed are not limitations of this invention.

Lift 10 includes an underlying base 12 having a leading or bow end 13 and a trailing or stern end 15. The base comprises a framework 14 composed of a corrosion-resistant or marine grade metal of the type commonly employed in boat lifts and other marine structures. Framework 14 is adjustably mounted on stanchions 16 supported on or under the sea floor or other bottom of a body of water by pads 17 or other suitable means. Framework 14 includes a generally parallel pair of longitudinal first and second side beams 18 and 19 that extend between and are attached to transverse beams 21 and 23. The transverse beams are mounted to and height adjustable on stanchions 16, which allows the height of framework 14 and lift 10 to be selected and adjusted as desired within the applicable marine environment.

A vertical support assembly 5 is pivotally mounted to base 12 for supporting a bunk assembly 7. The vertical support assembly includes a leading vertical H-frame support 9 comprising a juxtaposed first pair of leading vertical support beams 25, which are pivotally connected to respective longitudinal side beams 18, 19 proximate leading (bow) end 13 of framework 14. The vertical support assembly 5 also includes a trailing vertical H-frame support 11 comprising a juxtaposed second pair of trailing vertical support beams 27 that are likewise pivotally connected at their lower ends to respective longitudinal beams 18, 19 proximate the opposite, trailing (stern) end 15 of framework 14. As used herein, "vertical supports" and "vertical support beams" should be understood to encompass, include and refer to various types of supportive structural components, including, but not limited to beams, posts, columns, stanchions, and H-frame supports, which, as described below, provide underlying, height adjustable vertical support for a vessel mounted on the lift.

Bunk assembly 9 includes a pair of generally parallel boat-supporting bunks 28 and 30 are pivotally interconnected to the upper ends of the vertical support beams such that each bunk 28, 30 extends between a respective pair of vertical support beams 25 and 27. The lower end of each vertical support beam 25, 27 is pivotally attached to a respective horizontal side beam 18, 19 by a pivot bracket 32, FIG. 2. The pivot brackets, vertical support beams 25, 27 and bunks 28, 30 are likewise preferably constructed of strong and durable marine grade materials of the type conventionally employed in boat lifts. Each bunk 28, 30 may carry a longitudinal cushion 34, FIGS. 2 and 3, for engaging the hull of a supported boat (not shown) in order to minimize scratching and possible damage to the hull. In alternative embodiments, the bunks may be integrally interconnected, manufactured as a single piece or otherwise laterally joined by connective components within the scope of this invention.

Vertical support beams 25, 27 may feature a generally closed, rectangular cross sectional configuration or other elongate beam configuration (e.g., H-beam, I-beam) having at least one interior channel 37 extending longitudinally therethrough. The longitudinal sides of each trailing vertical support beam 27 carry respective mounting ears 38 that extend rearwardly from beam 27 and are positioned proximate the upper end of the beam. As described below in connection with FIGS. 10 and 11, the leading vertical support beams may alternatively include analogous mounting ears. Leading vertical support beams 25 are interconnected by a transverse horizontal strut 40 to form a leading H-frame support 41. Trailing beams 27 are likewise interconnected by a transverse horizonal strut 42 to form a trailing H-frame support 43. These H-frame supports strengthen and improve the structural integrity of lift 10.

Figure 3:
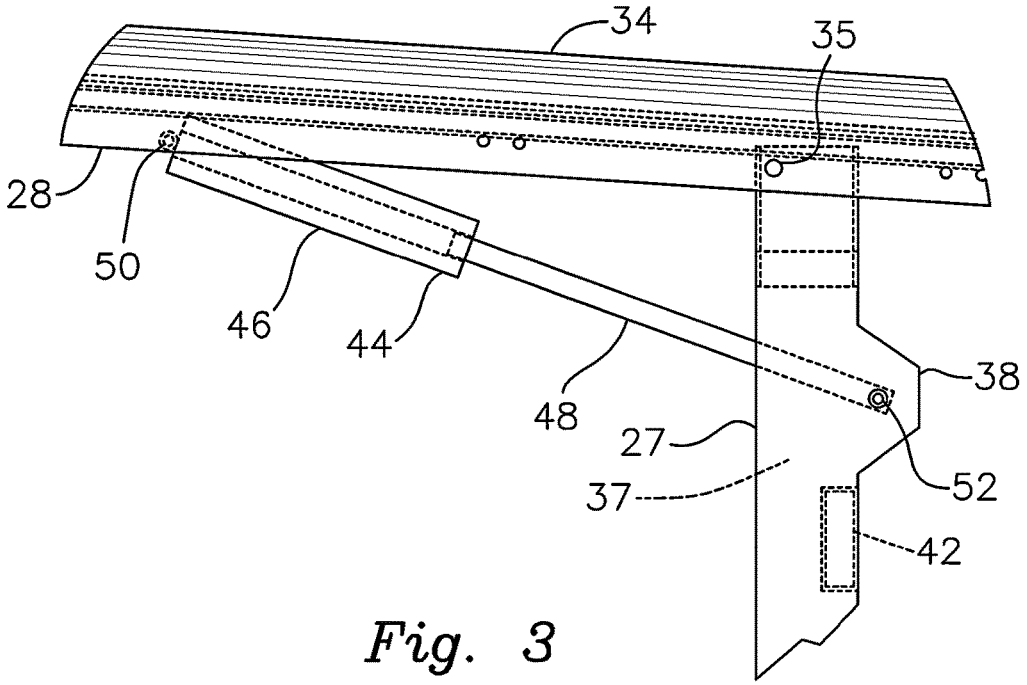
FIG. 3 is a fragmentary side view of a representative hydraulic cylinder actuator interconnected between an elongate bunk and a corresponding trailing vertical support beam in the raised condition.
Figure 4:
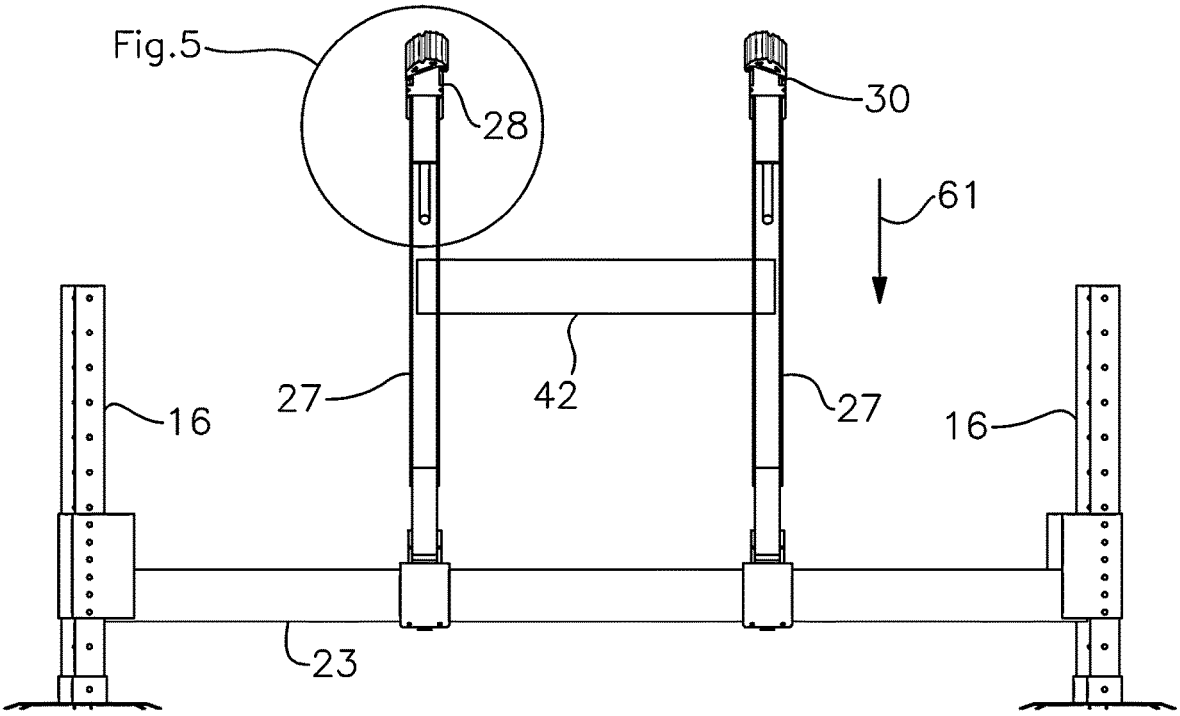
FIG. 4 is an end and partly cut away view of the hydraulic lift in the elevated condition.

Lift 10 is selectively raised and lowered by a pair of hydraulic cylinder actuators 44, FIGS. 1-3. A critical aspect of the present invention is the manner in which the hydraulic actuators are configured and installed in the lift and operated to pivotally raise and lower vertical support beams 25, 27, H-frame supports 41, 43 and supported bunks 28 and 30. Specifically, a respective hydraulic cylinder actuator 44 is operatively interconnected between each bunk 28, 30 and an associated one of trailing vertical support beams 27 (or alternatively the leading vertical support beams, as described below). As best shown in representative FIG. 3, each hydraulic actuator 44 includes a first reciprocating part comprising a cylinder barrel or housing 46 and a second reciprocating part comprising a hydraulic piston rod 48 operatively engaged in a known manner with cylinder housing 46. As used herein, "piston rod" should be understood to include an elongate rod or arm and attached piston as are conventionally employed in hydraulic cylinders of the type used in the boat lift industry and other applications. The leading end of each cylinder housing 46 is connected to a respective one of beams 28, 30 by a pivot 50 that is carried by bunk 28. Piston rod 48 extends from cylinder housing 46 into the longitudinal channel 37 of a corresponding vertical support beam 27 and the distal end of the rod is pivotally connected by a pin or bushing 52 to the mounting ears 38 of vertical support beam 27.

Hydraulic actuators 44 are connected to appropriate conventional hydraulic components comprising a hydraulic pump, associated hydraulic fluid lines and controls (not shown) that are operated as required to transmit hydraulic fluid to and from cylinder housings 46 and thereby selectively raise and lower vertical support beams 25 and 27, respective H-frames 41, 43 and supported bunks 28 and 30. FIGS. 1-4 depict the lift in a raised or elevated condition. Lift 10 and its vertical support beams, H-frames and supported bunks are shown in a lowered or collapsed condition in FIGS. 6-9 and in phantom in FIG. 2. When the lift is in the raised condition, cylinder rods 48 extend from their respective cylinder housings 46 to hold the corresponding vertical support beams 25, 27 in an upright condition.

Figure 5:
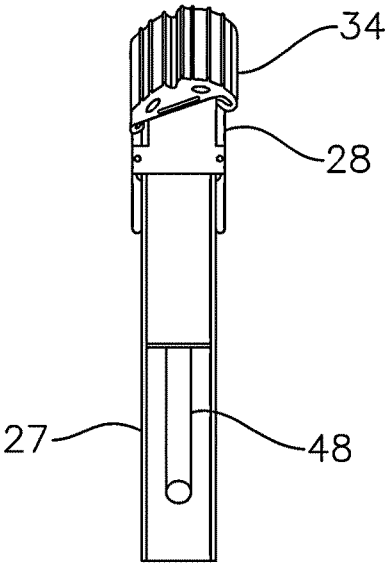
FIG. 5 is an end and partly cut away view of a representative vertical side beam and interconnected bunk with the actuator rod in the extended condition.
Figure 6:
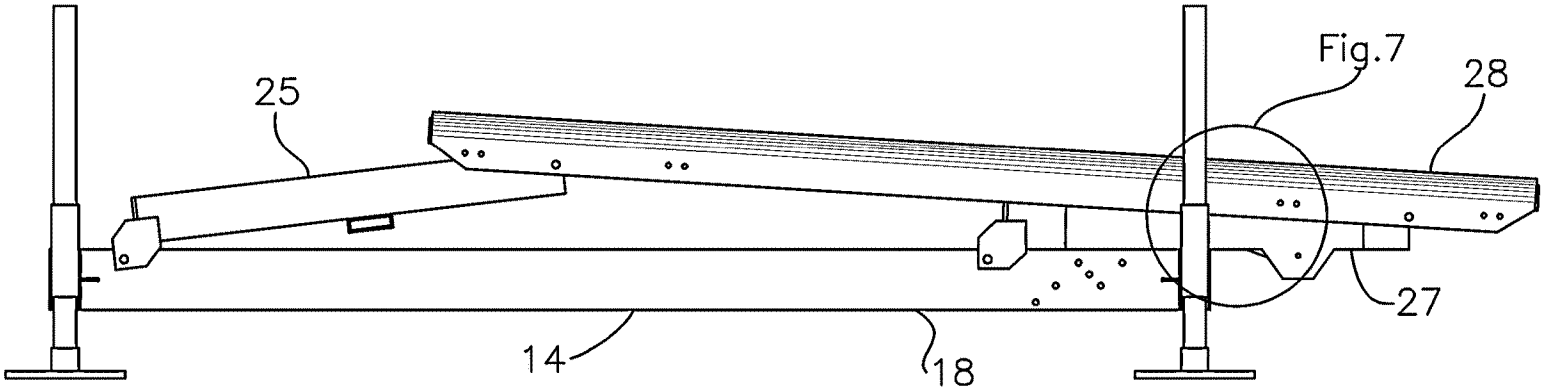
FIG. 6 is an elevational side view of the preferred hydraulic lift in the lowered or collapsed condition.
Figure 7:
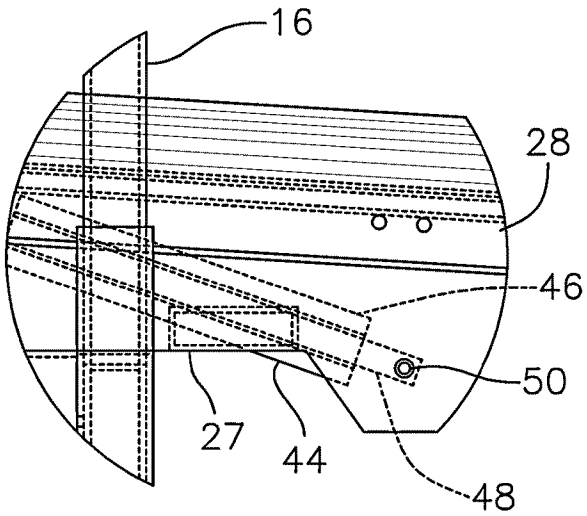
FIG. 7 is a fragmentary side view of the lowered lift with a representative cylinder actuator shown largely in phantom and depicting the rod in a retracted condition.
Figure 8:
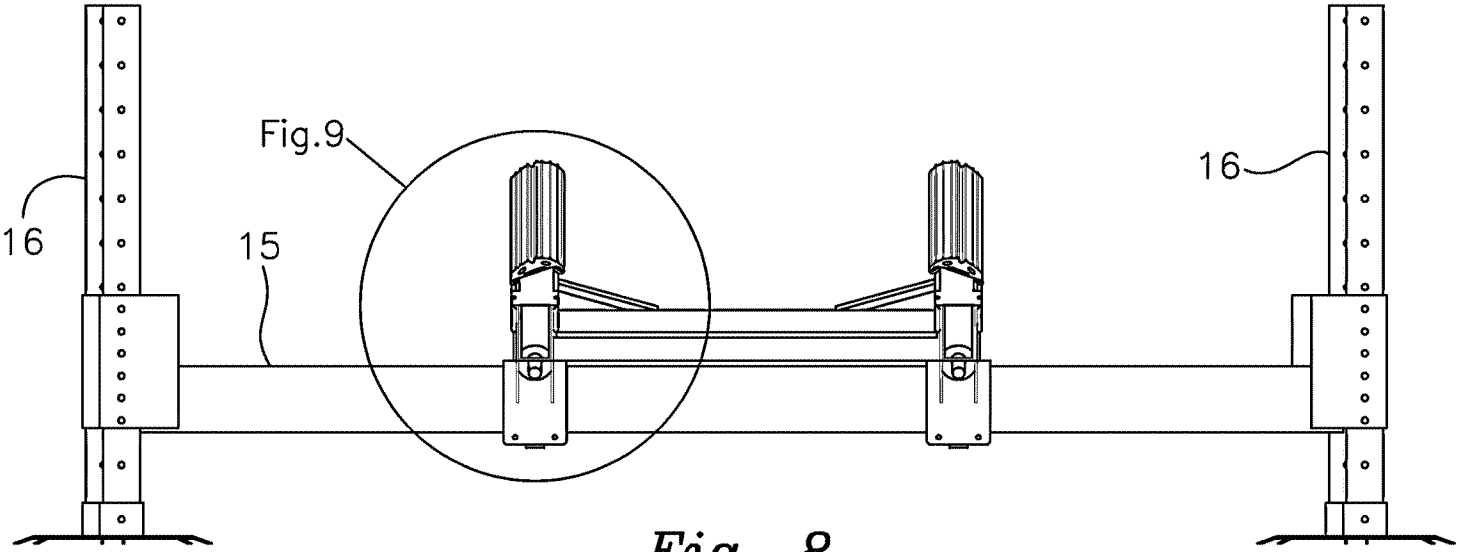
FIG. 8 is an elevational end and partly cut away end view of the lift in the lowered condition.
Figure 9:
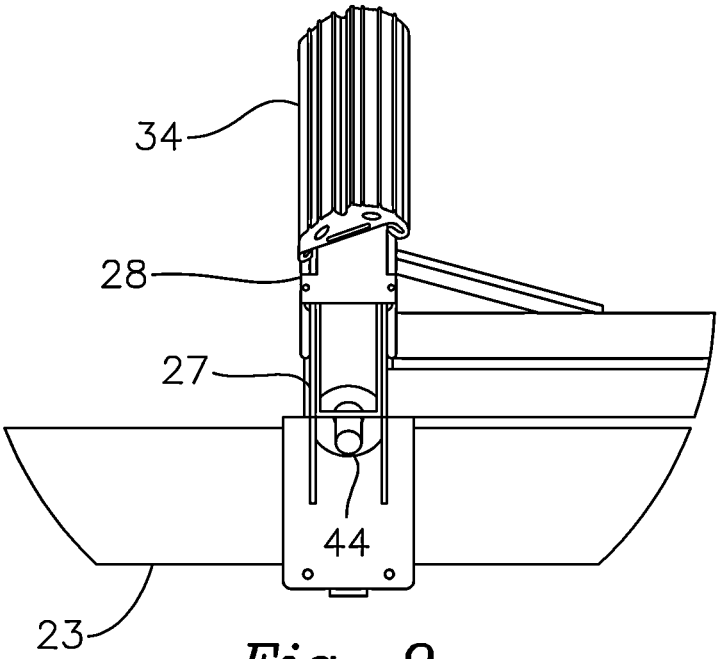
FIG. 9 is a fragmentary view of a representative vertical support beam, bunk and cylinder actuator in the lowered condition.

To subsequently lower lift 10, the hydraulic actuators are operated by removing fluid to retract rods 48 longitudinally into respective cylinder housings 46. This pulls the supported bunks 28, 30 in the direction of arrow 60, FIG. 2, which causes vertical support beams 25 and 27 and respective H-frames 41, 43 to pivot downwardly, as shown by arrows 61, FIGS. 2 and 4, into the lowered state shown in FIGS. 6 and 8. As best shown in FIG. 7, each piston rod 48 is pulled into its respective cylinder housing 46. The vertical support beams 25, 27 and connected bunks 28, 30 are thereby pivotally collapsed relative to side beams 18 and 19 with the upper ends of trailing beams 27 extending rearwardly beyond the stern of underlying lift framework 14. In the retracted condition shown in FIGS. 4 and 5, bunks 28 and 30 are angled to extend longitudinally downwardly in a rearward direction. This facilitates maneuvering a vessel onto and off of the lowered lift 10 when the lift is required to either retrieve a vessel from or launch the vessel into a surrounding body of water.

To subsequently raise the lift, cylinder actuators 44 are hydraulically operated (e.g., by introducing hydraulic fluid into the cylinder housings 46). This, in turn, extends rods 46 from respective cylinder housings 46, which causes bunks 28 and 30 and pivotally connected vertical support beams 25 and 27 to pivot open on the underlying framework 14 and rise upwardly from the lowered position shown in FIGS. 6 and 8 (and in phantom in FIG. 2) to the elevated position shown in FIGS. 1, 2, 4 and 9.

It is especially preferred that the vertical support beams 25 and 29 be configured and mounted to framework 14 and that the cylinder actuators 44 be constructed such that when the vertical support beams are pulled into the upright condition, those beams 25 and 27 are oriented overcenter or beyond center with respect to the underlying side beams 18, 19 of framework 14. As used herein, this means that each vertical support beam forms an angle of slightly greater than 90 degrees with its respective attached horizontal side beam 18, 19 relative to the trailing end 23 of framework 14. See, for example, angle A in FIG. 2. This prevents the vertical support beams from pivotally collapsing rearwardly and lowering the bunks 28 and 30 if the hydraulic pressure in one or more of the actuators 44 is lost and the actuator(s) fail. Even in the event of such failure, the overcenter positions of vertical support beams 25, 27 maintain the bunks and the supported vessel in the elevated condition. This significantly reduces the risk of damage to or loss of the boat, which could otherwise result if the lift collapses due to hydraulic actuator failure.

Figure 10:
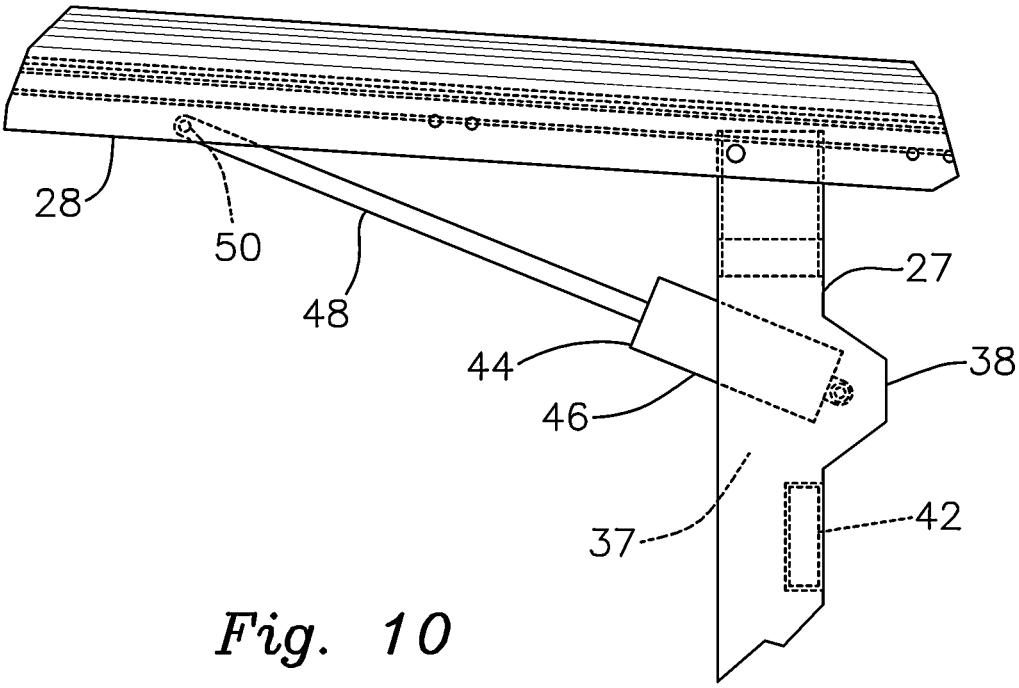
FIG. 10 is a fragmentary side view of an alternative version of a representative portion of the lift wherein the cylinder actuators are mounted between the trailing vertical support beams and their respective bunks in an orientation that is the reverse of that shown in FIGS. 1-9.

As shown in the alternative version of FIG. 10, each of actuating cylinders 44 may alternatively be installed and oriented in a reverse manner to that previously described such that each cylinder housing 46 is attached to pivot 52 extending between mounting ears 38 of each vertical support beam 27. By the same token, the distal end of interengaged rod 48 is secured by a respective pivot 50 to each of bunks 28 and 30. Otherwise, the actuating cylinders 44 and the overall hydraulic lift operate in a manner analogous to that previously described.

Figure 11:
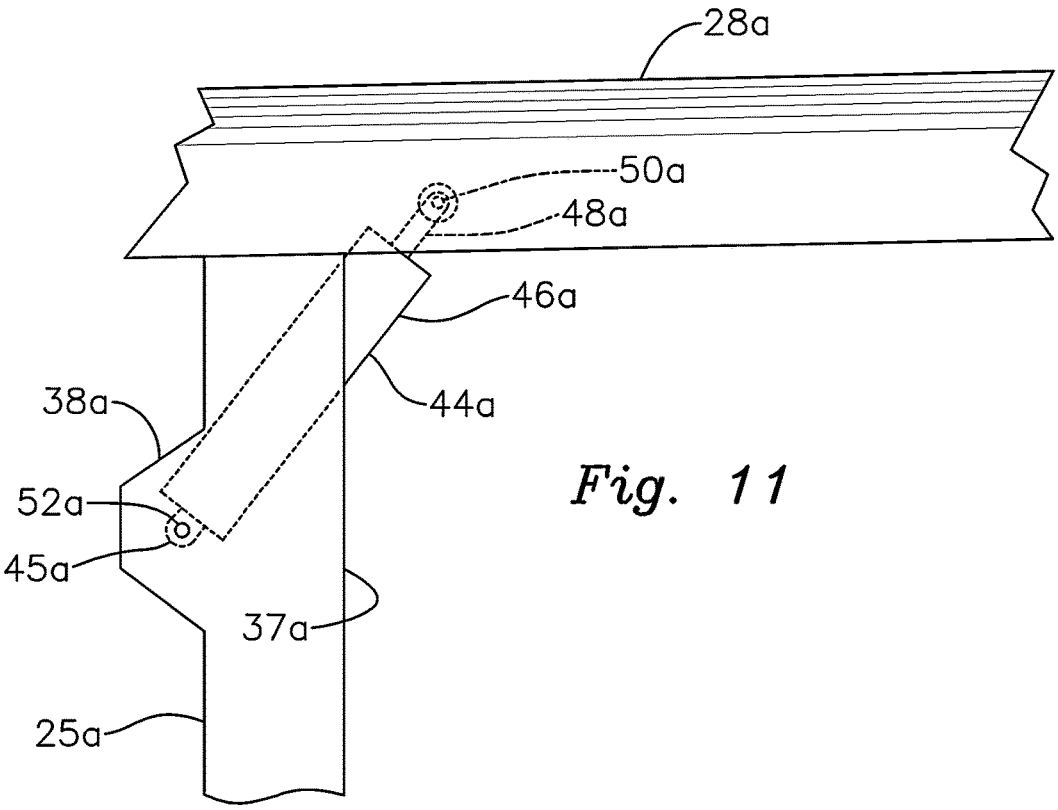
FIG. 11 is a fragmentary side view of an alternative preferred embodiment of a portion of the hydraulic lift specifically depicting a representative hydraulic cylinder actuator interconnected between an elongate bunk and a corresponding leading vertical support beam and wherein the cylinder actuator is in the raised condition.
Figure 12:
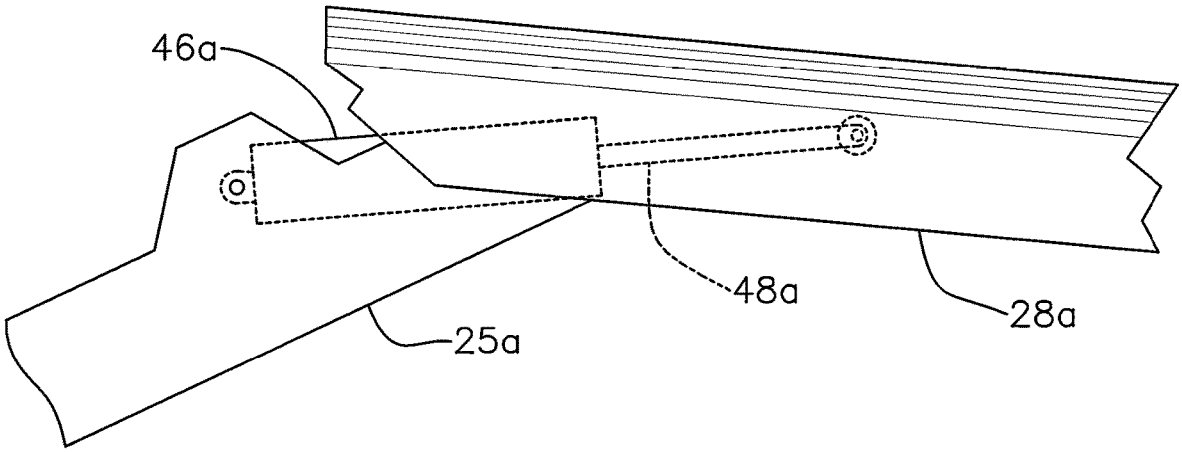
FIG. 12 is a fragmentary side view of the cylinder actuator of FIG. 11 with its piston rod extended to lower the lift.

There is shown in FIGS. 11 and 12 an alternative preferred embodiment wherein hydraulic cylinder actuators **44*a* are operably interconnected between each of the leading or bow vertical support beams 25 and their respectively connected bunks. FIGS. 11 and 12 depict a single representative actuator 44*a* interconnecting one of the leading vertical support beams 25*a* and representative bunk 28*a***. It should be understood that a similar hydraulic cylinder actuator may be interconnected in a like or analogous manner between the other leading vertical support beam and the second bunk (not shown). It should also be understood that the remaining components of the lift may be constructed identically or analogously to the components illustrated for the previously described version.

More particularly, each vertical support beam **25*a* includes a pair of spaced apart side walls that define an interior channel 37*a*. Each side wall carries a respective mounting ear 38*a* as previously described. Each actuator 44*a* includes a cylinder housing 46*a*. In the version shown in FIGS. 11 and 12, actuator 44*a* carries a mounting ring 45*a* that interengages a pin or pivot element 52*a* extending between the spaced apart mounting ears 38*a*. Actuator 44*a* also includes a piston rod 48*a* that operably engages cylinder housing 46*a*. The piston rod, in turn, is pivotably connected to a pivot pin 50*a* carried by respective bunk 28*a***.

A hydraulic cylinder actuator assembly as previously described is interconnected between each of the leading vertical support beams **25*a* and its respective pivotally connected bunk in a manner that is again analogous to the interconnection between the actuating cylinders, the trailing vertical support members and the respective bunks as set forth in the previously described embodiment. Again, the actuating cylinders 44*a* are hydraulically operated to selectively alternate the lift between the elevated or raised condition, shown in FIG. 11, and the lowered or collapsed condition shown in FIG. 12. To elevate the lift 10*a*, the piston rods 48*a* are pulled or retracted into the cylinder housings 44*a*. This causes both the forward and trailing vertical support beams and the pivotally interconnected bunks to pivotally rise into and held in the elevated condition shown in FIG. 11. Alternatively, the operation of the actuators 44***a* may be reversed to extend the piston rods 44*a* from their respective cylinder housings 46*a*. This causes the leading vertical support beams 25*a*, as well as the trailing vertical support beams, not shown in FIGS. 11 and 12, to pivot downwardly into the collapsed position shown in FIG. 12. The lift assembly therefore operates in a manner analogous to the previously described embodiment. It should likewise be understood that, as in the previously described embodiment, the orientation of the hydraulic cylinder actuators 44*a* may be reversed such that each piston rod is mounted between the mounting ears 38*a* of beams 25*a* and the cylinder housing 46*a* is pivotally mounted directly to a respective bunk. In either case, the piston rod is retracted into the cylinder housing in an elevated condition so that the rods remain protectively immersed in hydraulic fluid when the lift is elevated.

The present invention arranges and positions the hydraulic actuating cylinders at a unique and beneficial position on the boat lift. In contrast to existing lifts wherein the cylinders are interconnected between the underlying framework and the vertical support beams, in the present invention the hydraulic cylinders are operatively interconnected between the boat supporting bunks and a pair of laterally juxtaposed vertical support beams. As a result, the cylinders are conveniently placed overhead and well above the waterline when the lift is elevated. This improves access to the hydraulic cylinder actuators and greatly facilitates maintenance, repair and replacement of the hydraulic cylinders, as needed. The cylinders no longer remain largely, if not entirely submerged at virtually all times. The disclosed construction also achieves a smooth and effective lift operation. The lift features a compact profile in the lowered condition and the bunks are lowered sufficiently to allow a boat to be maneuvered onto and off of the lift, even in very shallow water conditions.

A significant additional benefit of the embodiment shown in FIGS. 11 and 12 is provided by retracting each piston rod into its corresponding cylinder housing when the lift is in the elevated position shown in FIG. 11. Therein, the majority of each rod 48*a* is retracted and remains disposed within cylinder housing 46*a* and is thereby immersed in hydraulic fluid whenever the lift is in the raised condition. Such fluid coats and protects the piston rod of the cylinder actuator not only when the lift is raised and supporting a boat, but also whenever the lift is raised without a vessel mounted thereon. Typically, the lift is elevated for the great majority of its service life. Continuously immersing most of the piston rod in hydraulic fluid greatly protects the rod and the cylinder actuator from excessive exposure to salt water, rough waters, severe weather and other efforts of a typically harsh marine environment, as well as the premature deterioration and maintenance costs caused by such exposure.

Accordingly, the present invention relates to an improved hydraulic boat lift and in particular to a system for uniquely installing the hydraulic cylinders such that they are operatively interconnected between the pivotable trailing support beams and corresponding bunks of the lift. While this detailed description has set forth particularly preferred embodiments of the apparatus of this invention, numerous modifications and variations of the structure of this invention, all within the scope of the invention, will readily occur to those skilled in the art. As previously indicated, the arrangement and orientation of the cylinder actuators in each version of this invention may be reversed between the vertical support beam and the bunk within the scope of this invention to achieve the benefits and advantages described herein. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

The invention claimed is:

1. A hydraulic boat lift comprising:

a supportive base for mounting to the floor of a body of water;

a vertical support assembly pivotally attached proximate a lower end thereof to respective opposing first and second sides of said base;

a bunk assembly pivotally interconnected to said vertical support assembly proximate an upper end of said vertical support; and a pair of hydraulic cylinder actuators pivotally connected at respective lower first ends of said actuators to said vertical support assembly and pivotally connected at respective opposite second ends of said actuators to said bunk assembly; said hydraulic cylinder actuators being operated to drive said vertical support assembly and said bunk assembly selectively between a pivotally opened condition wherein said vertical support assembly raises said bunk assembly and a pivotally closed condition wherein said vertical support assembly lowers said bunk assembly and said base remains mounted to the floor of the body of water;

each said hydraulic cylinder actuator including a cylinder housing and a piston rod operatively interengaged with said cylinder housing for moving selectively in a reciprocating manner inwardly and outwardly relative to said cylinder housing; said piston rods being selectively retracted into said cylinder housings for pivotally opening said bunk assembly and said vertical support assembly to raise said bunk assembly; said piston rods being selectively extended from said cylinder housings for pivotally closing said bunk assembly and said vertical support to lower said bunk assembly;

said cylinder housings accommodating hydraulic fluid for coating and protecting said piston rods when said bunk assembly is raised and said piston rods are retracted into said cylinder housings; said lower first end of each said hydraulic cylinder actuator being pivotally connected to said vertical support assembly at a vertical position on said vertical support assembly sufficiently proximate said bunk assembly such that when said piston rods are retracted into said cylinder housings to raise said bunk assembly, said cylinder housings and said piston rods are supported above the body of water.

2. The apparatus of claim 1 in which said vertical support assembly includes a leading vertical support having a spaced apart pair of laterally adjacent leading vertical support beams pivotally attached to said first and second sides respectively of said base proximate a leading end of said base and a trailing vertical support having a spaced apart pair of laterally adjacent trailing vertical support beams, each trailing vertical support beam being pivotally attached to a respective one of said first and second sides of said base; said leading and trailing vertical support beams attached to said first side of said base being pivotally interconnected to said first bunk, and said leading and trailing vertical support beams pivotally attached to said second side of said base being pivotally interconnected to said second bunk.

3. The apparatus of claim 2 in which said bunk assembly includes a first bunk pivotally interconnected to and extending between said leading and trailing vertical support beams attached to said first side of said base and a second bunk disposed laterally of said first bunk, said second bunk pivotally connected to and extending between said leading and trailing vertical support beams attached to said second side of said base; each said hydraulic cylinder actuator is pivotally connected at said first end to a respective one of said leading vertical support beams and is pivotally connected at said second end to a respective one of said first and second bunks.

4. The apparatus of claim 2 in which each said hydraulic cylinder actuator includes a cylinder housing pivotally connected to a respective one of said first and second bunks, and each hydraulic cylinder actuator also includes a piston rod operatively interengaged with said cylinder housing for moving selectively in a reciprocating manner inwardly and outwardly relative to said cylinder housing and pivotally connected to a respective one of said trailing vertical support beams.

5. The apparatus of claim 2 in which each said hydraulic cylinder actuator includes a cylinder housing pivotally connected to a respective one of said leading vertical support beams, and each hydraulic cylinder actuator also includes a piston rod operatively interengaged with said cylinder housing for moving selectively in a reciprocating manner inwardly and outwardly relative to said cylinder housing, a distal end of said piston rod being pivotally connected to a respective one of said first and second bunks.

6. The apparatus of claim 2 in which said leading support further includes a lateral strut interconnecting said first pair of vertical support beams to define a leading H-frame.

7. The apparatus of claim 2 in which said trailing support further includes a lateral strut interconnecting said second pair of vertical support beams to define a trailing H-frame.

8. The apparatus of claim 2 in which said leading and trailing vertical support beams are pivotally mounted to said base such that actuation of said hydraulic cylinder actuators causes each leading and trailing vertical support beam to pivot overcenter and form an angle greater than 90 degrees relative to a trailing end of said base whereby said leading and trailing vertical support beams are prevented from pivoting closed in the event that one or more of said hydraulic cylinder actuators fails.

9. The apparatus of claim 2 in which each said hydraulic cylinder actuator includes a cylinder housing pivotally connected to a respective one of said leading vertical support beams, each said hydraulic cylinder actuator also including a piston rod operatively interengaged with said cylinder housing for moving selectively in a reciprocating manner inwardly and outwardly relative to said interengaged cylinder housing and being pivotally connected at a distal end of said piston rod to a respective one of said first and second bunks, said piston rods being selectively retracted into respective said interengaged cylinder housings for pivotally opening said first and second bunks and said leading and trailing vertical support beams to raise said first and second bunks, and in which said piston rods are selectively extended from said respective interengaged cylinder housings for pivotally closing said first and second bunks and said leading and trailing vertical support beams to lower said first and second bunks.

10. A hydraulic boat lift for selectively raising a boat above and lowering the boat into a body of water, the hydraulic boat lift comprising:

An elongate supportive base for mounting to a floor of the body of water;

a leading vertical support, which includes a spaced apart pair of laterally adjacent leading vertical support beams pivotally attached to respective longitudinal first and second sides of said elongate base proximate a leading end of said base;

a trailing vertical support, which includes a spaced apart pair of laterally adjacent trailing vertical support beams pivotally attached to said respective longitudinal first and second sides of said elongate base; said base extending fully between and interconnecting said leading and trailing vertical supports;

a first bunk pivotally interconnected to, extending between and supported by said leading and trailing support beams attached to said first side of said elongate base;

a second bunk disposed laterally of said first bunk, said second bunk pivotally interconnected to, extending between and supported by said leading and trailing support beams attached to said second side of said elongate base; and a pair of hydraulic cylinder actuators, each said hydraulic cylinder actuator being pivotally connected at a first end of said actuator to a selected one of said leading and trailing vertical supports and being pivotally connected at an opposite second end of said actuator to a respective one of said first and second bunks at a longitudinal position on said respective bunk intermediate said leading and trailing vertical supports; said pair of hydraulic cylinder actuators being operated to selectively drive said leading and trailing vertical supports and said first and second bunks into a pivotally opened condition wherein said leading and trailing vertical supports raise said first and second bunks and a pivotally closed condition wherein said leading and trailing vertical supports lower said first and second bunks and said base remains mounted to the floor of the body of water; each said hydraulic cylinder actuator including a cylinder housing pivotally connected to a respective one of said leading vertical support beams, and each hydraulic cylinder actuator also including a piston rod operatively interengaged with said cylinder housing for moving selectively in a reciprocating manner inwardly and outwardly relative to said interengaged cylinder housing and being pivotally connected at a distal end of said piston rod to a respective one of said first and second bunks; said piston rods being selectively retracted into respective said interengaged cylinder housings for pivotally opening said first and second bunks and said leading and trailing vertical support beams to raise said first and second bunks, and said piston rods being selectively extended from said respective interengaged cylinder housings for pivotally closing said first and second bunks and said leading and trailing vertical support beams to lower said first and second bunks; each said cylinder housing accommodating hydraulic fluid for coating and protecting said interengaged piston rods when said first and second bunks are raised and said piston rods are retracted into said respective interengaged cylinder housings; a lower end of each said cylinder housing being pivotally connected to a respective leading vertical support beam at a longitudinal position on said respective leading vertical support beam sufficiently proximate said first and second bunks such that when said piston rods are retracted into said respective interengaged cylinder housings to raise said first and second bunks, said cylinder housings and retracted piston rods are supported above the body of water.

11. A hydraulic boat lift comprising:

a supportive base for mounting to the floor of a body of water;

a leading vertical support, which includes a spaced apart pair of laterally adjacent leading vertical support beams pivotally attached to respective opposing first and second sides of said base proximate a leading end of said base;

a trailing vertical support, which includes a spaced apart pair of laterally adjacent trailing vertical support beams pivotally attached to said respective opposing first and second sides of said base proximate a trailing end of said base; said base extending fully between and interconnecting said leading and trailing vertical support beams;

a first bunk pivotally interconnected to and extending between said leading and trailing vertical support beams attached to said first side of said base;

a second bunk disposed laterally of said first bunk, said second bunk pivotally connected to and extending between said leading and trailing vertical support beams attached to said second side of said base; and a pair of hydraulic cylinder actuators, each said hydraulic cylinder actuator being pivotally connected at a lower first end of said actuator to a respective said leading vertical support beam and being pivotally connected at an opposite second end of said actuator to a respective one of said first and second bunks; said pair of hydraulic actuator cylinders being operated to drive said leading and trailing vertical supports and said first and second bunks selectively between a pivotally opened condition wherein said leading and trailing vertical supports raise said first and second bunks and a pivotally closed condition wherein said leading and trailing vertical supports lower said first and second bunks and said base remains mounted to the floor of the body of water;

each said hydraulic cylinder actuator including a cylinder housing and a respective piston rod operatively interengaged with said cylinder housing for moving selectively in a reciprocating manner inwardly and outwardly relative to said cylinder housing; said respective piston rods being selectively retracted into said cylinder housings for pivotally opening said first and second bunks and said leading and trailing supports to raise said first and second bunks; said respective piston rods being selectively extended from said cylinder housings for pivotally closing said first and second bunks and said leading and trailing supports to lower said first and second bunks;

said cylinder housings accommodating hydraulic fluid for coating and protecting said respective piston rods when said first and second bunks are raised and said respective piston rods are retracted into said cylinder housings; said lower first end of each said actuator being pivotally connected to said respective leading vertical support beam at a longitudinal position on said respective leading vertical support beam sufficiently proximate said first and second bunks such that when said respective piston rods are retracted into said respective cylinder housings to raise said first and second bunks, said cylinder housings and said respective piston rods are supported above the body of water.

12. A hydraulic boat lift comprising:

a supportive base for mounting to the floor of a body of water;

spaced apart leading and trailing vertical supports, each including a vertical H-frame support pivotally attached to opposing first and second sides of said base;

a first bunk pivotally interconnected to and supported by said vertical H-frame supports;

a second bunk disposed laterally of said first bunk, said second bunk pivotally connected to and supported by said vertical H-frame supports; and a pair of hydraulic cylinder actuators, each said hydraulic cylinder actuator being pivotally connected at a lower first end of said actuator to a same one of said vertical H-frame supports and being pivotally connected at an opposite second end of said actuator to a respective one of said first and second bunks; said pair of hydraulic actuator cylinders being operated to drive said vertical H-frame supports and said first and second bunks selectively between a pivotally opened condition, wherein said vertical H-frame supports raise said first and second bunks, and a pivotally closed condition, wherein said vertical H-frame supports lower said first and second bunks and said base remains mounted to the floor of the body of water;

each said hydraulic cylinder actuator including a cylinder housing and a respective piston rod operatively interengaged with said cylinder housing for moving selectively in a reciprocating manner inwardly and outwardly relative to said cylinder housing; said respective piston rods being selectively retracted into said cylinder housings for pivotally opening said first and second bunks and said vertical H-frame supports to raise said first and second bunks; said respective piston rods being selectively extended from said cylinder housings for pivotally closing said first and second bunks and said vertical H-frame supports to lower said first and second bunks;

said cylinder housings accommodating hydraulic fluid for coating and protecting said respective piston rods when said first and second bunks are raised and said respective piston rods are retracted into said cylinder housings; each said actuator being pivotally connected at said first end of said actuator to said same one of said vertical H-frame supports at a vertical position on said vertical H-frame support sufficiently proximate said first and second bunks such that when said respective piston rods are retracted into said interengaged cylinder housings to raise said first and second bunks, said cylinder housings and said retracted piston rods are supported above the body of water.

* * * * *